US006294867B1

(12) United States Patent
Lynn

(10) Patent No.: US 6,294,867 B1
(45) Date of Patent: Sep. 25, 2001

(54) FLOURESCENT LAMP WITH UNIFORM OUTPUT

(76) Inventor: Judd Lynn, 4408 Slide Cir., Colorado Springs, CO (US) 80917

( * ) Notice: Subject to any disclaimer, the term of this patent is extended or adjusted under 35 U.S.C. 154(b) by 0 days.

(21) Appl. No.: 09/237,206

(22) Filed: Jan. 25, 1999

(51) Int. Cl.[7] ..... H01J 17/16
(52) U.S. Cl. ..... 313/422; 313/493
(58) Field of Search ..... 313/493, 634, 313/609, 610, 611, 612, 422; 220/2.1 R; 315/58

(56) References Cited

U.S. PATENT DOCUMENTS

| | | | | |
|---|---|---|---|---|
| D. 385,379 | | 10/1997 | Tillotson | D26/76 |
| 2,987,640 | * | 6/1961 | Paolino | 313/204 |
| 3,047,763 | | 7/1962 | Inman | 313/109 |
| 3,253,176 | * | 5/1966 | Pate et al. | 313/204 |
| 3,508,103 | | 4/1970 | Young | 313/109 |
| 3,646,383 | | 2/1972 | Jones et al. | 313/109 |
| 3,668,455 | * | 6/1972 | Dale | 313/109 |
| 4,180,164 | | 12/1979 | Durden et al. | 206/419 |
| 4,477,748 | | 10/1984 | Grubbs | 315/309 |
| 4,598,343 | | 7/1986 | Sorrell | 362/216 |
| 4,647,137 | | 3/1987 | Sorrell | 339/144 |
| 4,723,098 | | 2/1988 | Grubbs | 315/306 |
| 4,791,338 | | 12/1988 | Dean et al. | 315/174 |
| 4,873,471 | | 10/1989 | Dean et al. | 315/308 |
| 4,978,888 | | 12/1990 | Anandan et al. | 315/58 |
| 5,122,074 | | 6/1992 | Maag et al. | 439/237 |
| 5,128,592 | | 7/1992 | Dean et al. | 315/224 |
| 5,233,262 | | 8/1993 | Lynn et al. | 313/113 |
| 5,343,115 | | 8/1994 | Anandan et al. | 313/491 |
| 5,438,928 | | 8/1995 | Chatwin et al. | 101/369 |
| 5,463,274 | | 10/1995 | Winsor | 313/493 |
| 5,466,990 | | 11/1995 | Winsor | 315/56 |
| 5,479,069 | | 12/1995 | Winsor | 313/493 |
| 5,479,071 | * | 12/1995 | Lynn | 313/514 |
| 5,509,841 | | 4/1996 | Winsor | 445/26 |
| 5,536,999 | | 7/1996 | Winsor | 313/493 |
| 5,552,664 | | 9/1996 | Csoknyai et al. | 313/488 |
| 5,744,906 | * | 4/1998 | Alford et al. | 313/493 |

* cited by examiner

*Primary Examiner*—Michael H. Day
*Assistant Examiner*—Matthew J. Gerike
(74) *Attorney, Agent, or Firm*—Chernoff, Vilhauer, McCLung & Stenzel LLP

(57) ABSTRACT

A flat form gas discharge lamp for illuminating a defined area includes a plurality of adjacent spaced apart substantially parallel channels extending across the defined area. The first channels are substantially co-planar with one another, and a plurality of second channels interconnecting end portions of respective pairs of the first channels to form a single confined region such that the first channels confine an ionizable medium for producing light under influence of an electric discharge. The second channels are substantially co-planar with one another while not being co-planar with the first channels.

14 Claims, 4 Drawing Sheets

FLOURESCENT LAMP WITH UNIFORM OUTPUT

BACKGROUND OF THE INVENTION

The present invention relates to a planar fluorescent lamp with features to provide uniform luminescence.

Thin, planar, durable, easily manufacturable and relatively large area light sources having a range of light intensity are useful in many applications. Such light sources are particularly useful as backlight sources for Liquid Crystal Displays (LCD) to provide readability in a wide range of ambient lighting conditions, from night time to direct sunlight. Such backlight sources are commonly used in avionics, industrial, mobile, and medical applications. Such sources must be very uniform so that the display is not adversely effected by bright or dim spots or patterns of light. Uniform light sources may also be tiled together to form even larger uniform light sources for back illuminating large LCD or transparency images such as X-ray films.

To construct uniform backlight sources the actual light source is placed behind a translucent material that diffuses the underlying light source. The diffuser absorbs light and reduces the amount that reaches the back of the display to be backlighted. The more transparent the diffuser is, the more efficient the backlight system is. However, the more transparent the diffuser is, the less diffusing it does. So, an efficient diffuse backlight system needs to have an inherently uniform original light source so the diffuser can be highly transparent and still be sufficiently diffuse.

Other forms of lighting devices may be used to create uniform light sources. Incandescent lamps and light emitting diodes may be used, however they have poor color qualities and poor luminous efficiency, resulting in high power consumption and heat generation.

An alternative to incandescent lights and light emitting diode arrays is fluorescent technology. Tubular fluorescent lamps have the advantage of being relatively efficient, generating relatively bright light, and having well-established manufacturing capability. In particular, serpentine tubes are especially efficient because they use a long channel length which minimizes parasitic electrode losses. However, tubular fluorescent lamps suffer from fragility requirements when used as optical elements to reflect and diffuse light, are not very durable for harsh environments, and have limited capability to operate effectively and effectively in low light applications.

There are types of flat planar fluorescent lamps that represent improvements in light output uniformity because they incorporate closely spaced patterns of serpentine light. Several planar fluorescent lamps are known in the art such as U.S. Pat. Nos. 3,508,103, 3,646,383 and 3,047,763. Typically such planar lamps are made with two plates of glass spaced apart with a separation material to form channels inside. The channels are coated with phosphorous material, filled with a selected gas and mercury vapor, electrodes are placed at channel ends and a discharge is caused by a high voltage and current flow. In these cases the light is more uniform than separate tubes would create, but there is still non-uniformity between the lighted channels. These kind of planar serpentine lamps do have the added efficiency of long channel lengths described for tubular serpentine lamps.

Lynn et al., U.S. Pat. No. 5,233,262, disclose a planar fluorescent lamp that defines a serpentine channel therein. The light emitted across the planar lamp is non-uniform because of the non-light emitting regions between the channels. To provide increased brightness, increased uniformity, and increased efficiency, an optical reflector is placed in the areas between the lighted channels which directs reflected light toward the front of the lamp. However, in a typical planar lamp the channels are formed into a serpentine pattern. At the turning ends there is an increased unlighted area where the lamp radius diverge. This results in less light per overall area being generated in the serpentine area. As a result, when the entire lamp is covered with a diffuser to homogenize the light, the serpentine bend areas appear less bright and uniformity suffers. It is known in the art that various optical devices, such as Fresnel lens sheets, can be used to concentrate light and to cause linear double imaging, which improves uniformity at the diffuser level, which allows the use of a more transparent diffuser, which makes the backlight system more efficient. However, such films are linear and if they are place in front of a serpentine pattern light source with their elements parallel to the main direction of the light sources, then when the light sources bend in their turns, the film has an undesirable optical result and there is nonuniform light radiated at the diffuser, resulting in non uniform light out of the diffuser. So planar fluorescent lamps that include serpentine lighted patterns in the lighted area of interest require more diffusing to make them uniform and as a result suffer losses in optical efficiency. In applications which require uniform light output across the entire lamp, the curved end portions are masked to prevent the light originating from the curved end portions from reaching the viewer. Unfortunately, the resulting masked display has a reduced useful area, decreased efficiency by having a masked region, a perimeter that is significantly greater than the nonmasked illuminated region, and a manufacturing expense greater than a display having a visible region the same as the nonmasked region.

What is desired, therefore, is a planar fluorescent lamp to create diffused uniform light that has uniform light output, increased efficiency, minimal size, no masking, and reduced manufacturing expense.

SUMMARY OF THE INVENTION

The present invention overcomes the aforementioned drawbacks of the prior art by providing a flat form gas discharge lamp for illuminating a defined area that includes a plurality of adjacent spaced apart substantially parallel channels extending across the defined area. The first channels are substantially co-planar with one another, and a plurality of second channels interconnecting end portions of respective pairs of the first channels to form a single confined region such that the first channels confine an ionizable medium for producing light under influence of an electric discharge. The second channels are substantially coplanar with one another while not being co-planar with the first channels.

In the preferred embodiment, the lamp therefore may include a set of straight channels without curved portions at the ends thereof. The resulting lamp has uniform light output without variation in the direction or spacing of the lighted channel. Such a configuration of lighted channels allows the use of optical films without anomalies caused by misdirection of channel and film optics and diffusers that are relatively transmissive but are sufficiently diffuse which produce a highly efficient diffuse lighting system. In addition, the entire surface of the lamp is useful for applications that require uniform light output, such as reading photo negatives. Also, such a lamp is useful for applications that have packaging limitations while still requiring uniform light output to the perimeter of the lamp. Moreover, increased light uniformity is achieved while using a single continuous arc stream in the advantageous manner of a long channel serpentine lamp with a single pair of electrodes one situated at each end, which minimizes power losses. The addition of additional electrodes would greatly reduce the lamp's efficiency.

DETAILED DESCRIPTION OF THE PREFERRED EMBODIMENT

Figure 1:
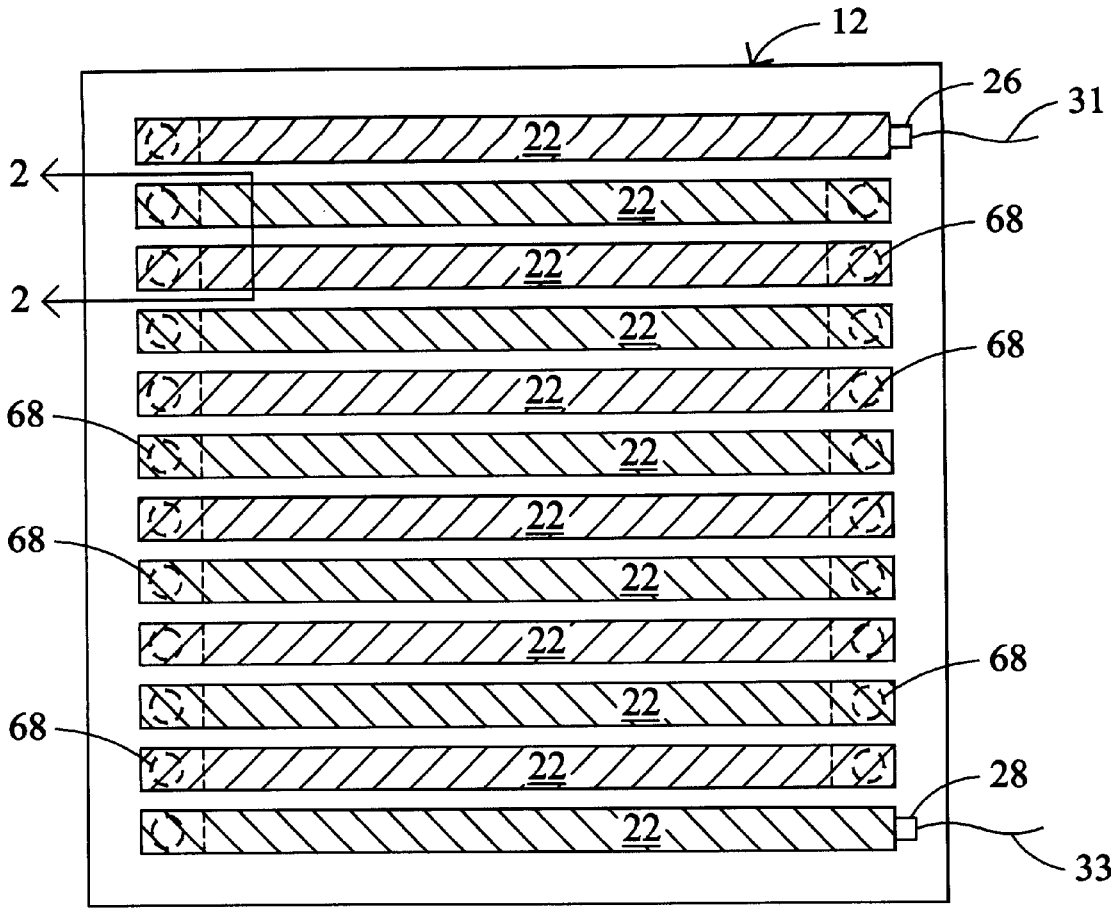
FIG. 1 is plan view of an exemplary embodiment of a flat form lamp.
Figure 2:
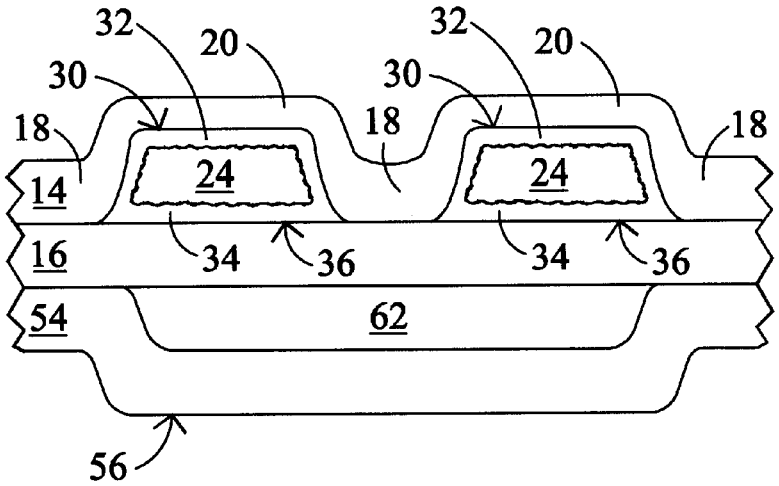
FIG. 2 is a sectional view along line 2—2 of the lamp of FIG. 1.

Referring to FIGS. 1 and 2, a flat form lamp 12 for providing a uniform light output is shown. The lamp 12 is comprised of a first plate 14 molded to form the desired pattern and which is mounted above a second plate 16. The first and second plates 14 and 16 are formed of a suitable transparent or translucent material such as clear glass or other vitreous materials.

The first plate 14 is molded with planar base portions 18 and shaped portions 20 which project forward from the plane of the base portions 18. The shaped portions 20 are molded to form a set of straight, or substantially straight, channel patterns 22 across the display 12.

The inner surfaces 30 of the shaped portions 20 and the upper surface 36 of the second plate 16 are spaced apart to define channels or cavities 24 therebetween. The planar base portion 18 of the first plate 14 is mounted by suitable techniques, such as a glass frit seal or glass welding, across the facing upper surface of the second plate 16 about the perimeter of the shaped portions 20 to hermetically seal the cavities 24. The first plate 14 is also formed with a pair of raised pockets 26 and 28 at opposite ends of the shaped portions 20 for placement of electrodes 31 and 33. The pockets 26 and 28 communicate with the cavities 24 and are also hermetically sealed. The cavities 24 are exhausted to a partial vacuum by a suitable exhaust tube, not shown, or other suitable mechanisms.

Figure 3:
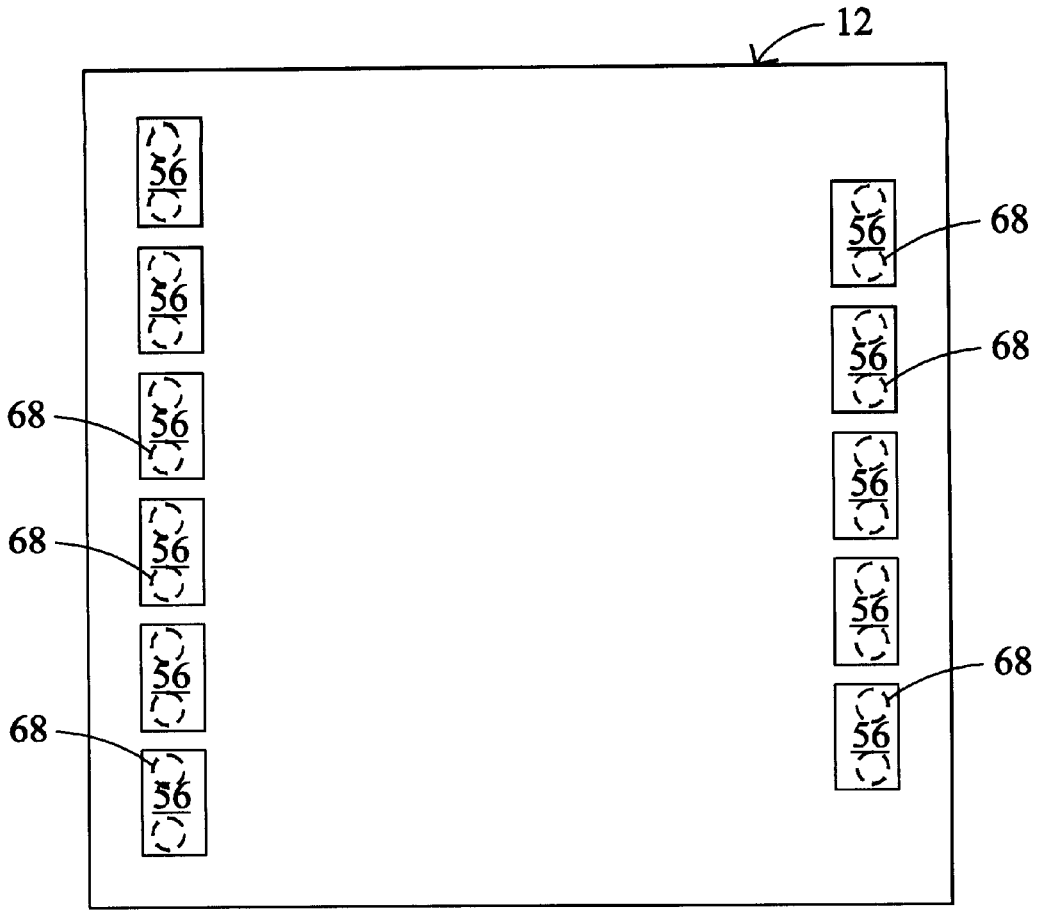
FIG. 3 is a rear view of the lamp of FIG. 1.

Referring to FIGS. 2 and 3, a third glass plate 54 is mounted against and hermetically sealed with the rear surface of the second plate 16. The third plate 54 is molded with a plurality of shaped portions 56. The shaped portions 56 of the third plate are spaced rearwardly from the second plate to define channels 62 therebetween. Holes 68 are formed in second plate 16 for communicating gas between channels 62 and channels 22. The channels 62 formed by the third plate 54, together with the holes 68 formed in the second plate 16 create an interconnect path that provides a continuous gas discharge path between the electrodes 31 and 33 along the length of the shaped portions 20 of the first plate 14.

As shown in FIGS. 1 and 3, the cavities 24 and 62 are preferably of uniform depth but could be varied in accordance with the particular application. Wall thickness of the first, second, and third plates 14, 16 and 54 can be in the range of 0.02 inches to 0.06 inches. The total thickness of the combined front plate 14, cavity 24, and rear plate 16 can be in the range of 0.15 inches to 0.50 inches. While it is shown that the first, econd, and third plates 14, 16 and 54 are molded with the channels 22 and 62, the invention contemplates that the second plate 16 could be molded with the shaped portion while the front plate 14 is flat, or both first plate 14 and second plate 16 could be formed with shaped portions. In any such manner, the straight or substantially straight channels can be achieved.

During fabrication, the inner surfaces 30 of the first plate 14 are coated with a layer of phosphors 32 of the type that absorb ultraviolet radiation and irradiate at wave lengths visible to the human eye. Another layer of phosphors 34 can be coated on the upper surface 36 of the second plate 16. An activated powered phosphor such as magnesium tungstate or calcium Fluorochlorophosphate:Antimony:Manganese is suitable for this purpose. As desired, a suitable reflector layer, not shown, may be provided under phosphor layer 32 and over the inner surface 36 of the second plate 16 to increase brightness. The phosphors 32 and 34 and reflector material can be deposited by spraying, screen printing or other suitable techniques. The phosphors 32 and 34 can be selected in accordance with the light which they emit, and a single color phosphor can be used as well as a combination of different phosphors to provide multiple colors.

After evacuation, the cavities 24 and 62 are filled with a low pressure ionizable medium which carries electrical current. The ionizable medium can comprise an inert gas such as Argon which is charged with a small percentage of Mercury vapor to provide a fluorescent gas mixture. The ionizable medium could also comprise Neon gas or a Penning mixture, such as a mixture of Neon and Argon gasses or a mixture of Neon and Xenon gases. Gas pressure within the cavities 24 and 62 are preferably within the range of three to 33 torr.

The ionizable gaseous medium within the cavities 24 and 62 is excited into an electric discharge y a suitable control circuit, not shown, applying a voltage potential across electrodes 31 and 33. The control circuit can apply either a direct current or alternating current to the electrodes 31 and 33. The excited gas gives off photons of energy, and the partial pressure of the Mercury vapor is particularly rich in radiating UV photons. The phosphor coatings absorb the UV radiation and reradiate visible light which is emitted through the transparent shaped portions 20 to produce the lighted pattern. When the cavities 24 and 62 are filled with an ionizable medium comprising Neon or a mixture of Neon and other inert gas and mercury vapor, the current flow causes the Neon to itself emit a blue light.

A significant amount of light is not emitted from the cavities 62 in the third plate 54 because no phosphor is included therein. The cavities 62 do not include any phosphors therein so when an electrical control voltage is applied thereto it does not illuminate. It is to be noted that the electrical voltage does result in a faint light discharge from the gas within the cavities 62 but this does not significantly affect the uniform light output.

The third plate with its channels forming the interconnecting paths allows the front channels to be straight and free from curved portions. Accordingly, the lamp 12 has a set of straight channels 22 without the curved portions at the ends thereof. The resulting lamp 12 has uniform light output, and in particular at the ends of the channels 22. In addition, the entire surface of the lamp 12 is useful for applications that require uniform light output, such as reading photo negatives. Also, such a lamp is useful for applications that have packaging limitations while still requiring uniform light output to the perimeter of the lamp. Moreover, increased light uniformity is achieved while using a single continuous arc stream with one pair of electrodes, one at each end which minimizes power losses at the electrodes thereof. The addition of additional electrodes would greatly reduce the lamp's efficiency.

Figure 4:
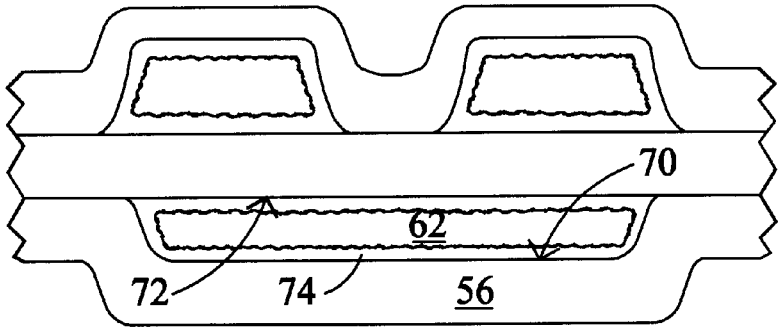
FIG. 4 is an alternative embodiment of the lamp of FIG. 1 shown in section.

The present inventor observed that the regions around the openings 68 have slightly decreased luminance. Referring to FIG. 4, in an alternative embodiment, the inner surface 70 of the shaped portions 56 and the rear surface 72 of the second plate 16 may be coated with phosphors 74 so that light shines through the holes 68 to provide increased uniform luminance. If the channels 22 are closely spaced together then adjacent channel walls will reflect the light emitting from each other. If the channels (22) are spaced apart then a reflector device such as tape or a molded shaped reflector can be placed between channels to enhance foreward reflected light and thus the uniformity.

Figure 5:
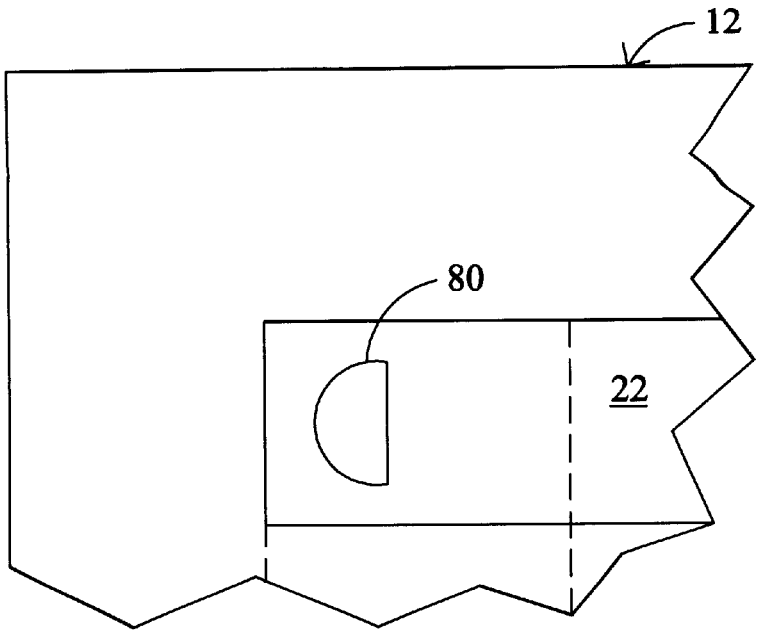
FIG. 5 is an alternative embodiment of the holes of the lamp of FIG. 1.

The arch path within the channels 22, 62 tends to select the shortest path between the electrodes 31 and 33. This results in the end portions of the channels 22 not being fully illuminated because the arc path enters the inner curved portions of the openings 68. Referring to FIG. 5, to increase the luminescence near the end of the channels 22, the holes 80 are preferably asymmetrical in nature, such as half a circle. The arch path is then forced to pass closer to the end of the channels 22 which increases the luminance at the end portions of the cavities 24.

Figure 6:
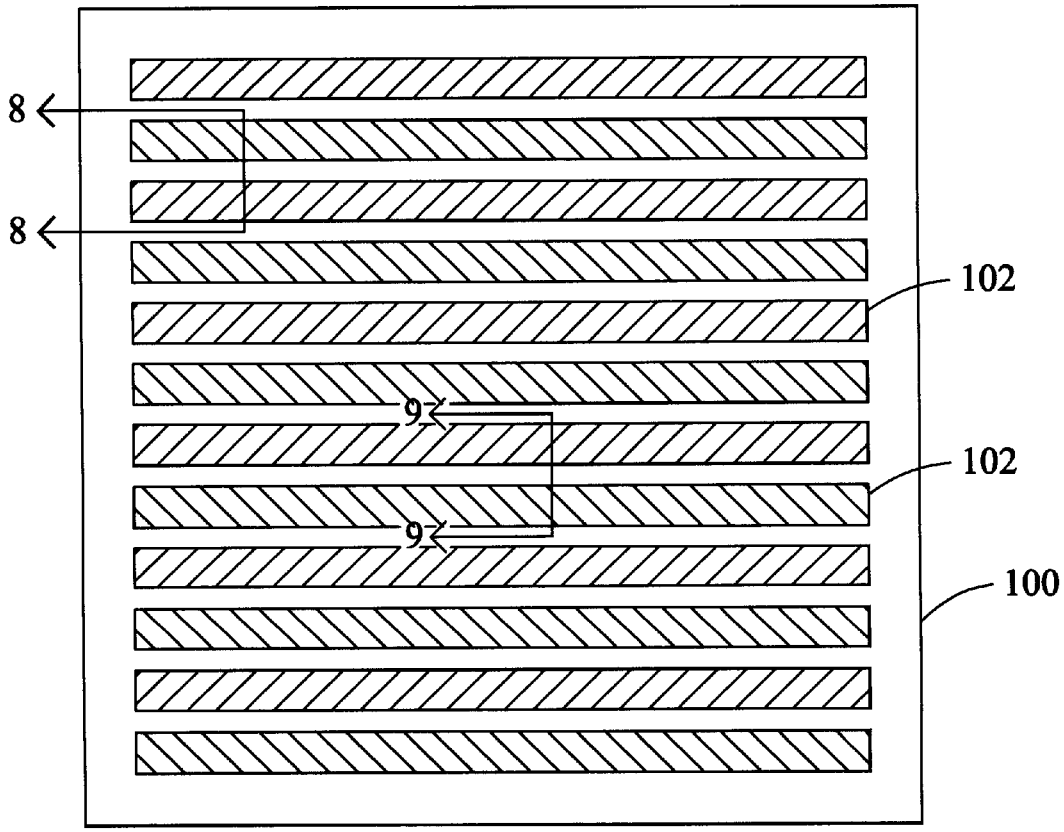
FIG. 6 is a plan view of another alternative embodiment of a flat form lamp.
Figure 7:
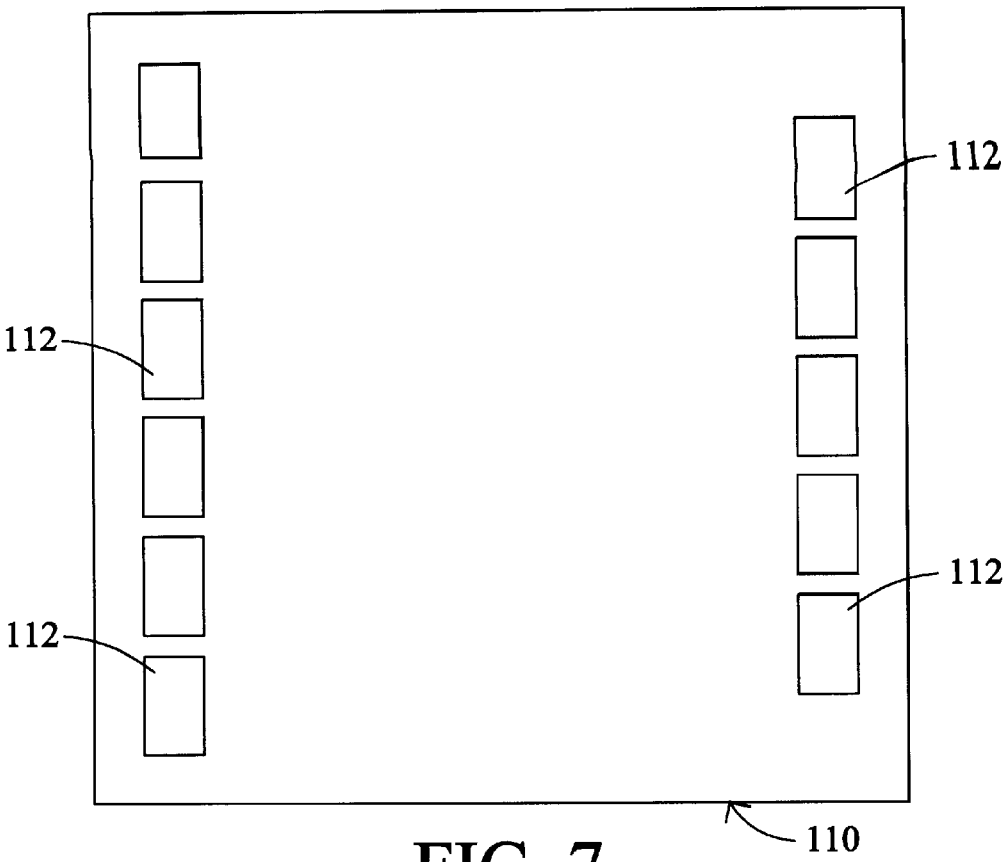
FIG. 7 is a rear view of the lamp of FIG. 6.
Figure 8:
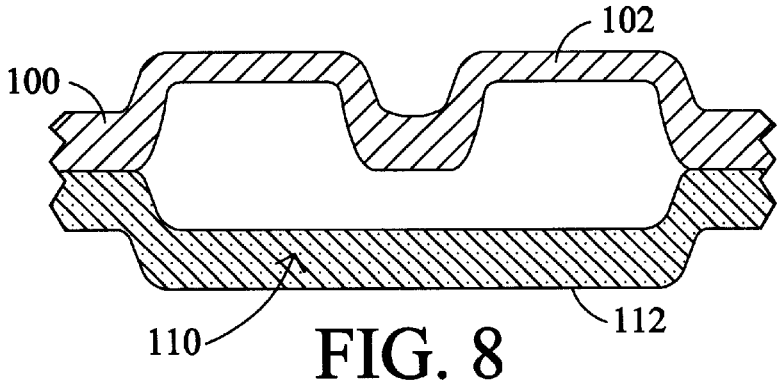
FIG. 8 is a sectional view along line 8—8 of the lamp of FIG. 6.
Figure 9:
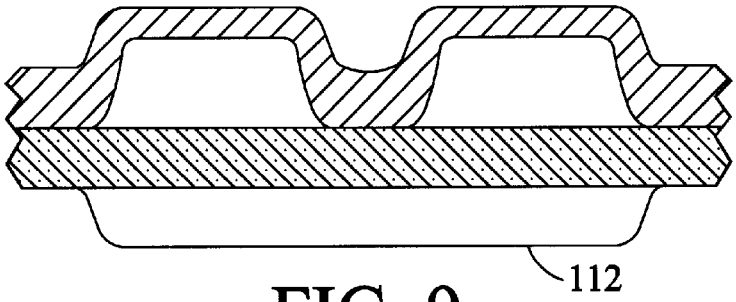
FIG. 9 is a sectional view along line 9—9 of the lamp of FIG. 6.

Referring to FIGS. 6–9, in an alternative embodiment, a set of two formed plates can be used to form the cavities. In this manner, the second plate can be eliminated. In particular, FIG. 6 illustrates an upper plate 100 with shaped portions 102 defined therein. FIG. 7 illustrates the lower plate 110 with the shaped portions 112 defined therein. The shaped portions 112 are sized and oriented to interconnect the ends of the shaped portions 102 together to form a continuous channel. FIG. 8 illustrates the combination of the upper plate 100 joined with the lower plate 110 and the arc path created between a pair of adjoining shaped portions 102. FIG. 9 illustrates the combination of the upper plate 100 joined with the lower plate 110 and the separation of the shaped portions 102 by the lower plate 110.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A flat form gas discharge lamp for illuminating a defined area, comprising:

(a) a plurality of first adjacent spaced apart substantially parallel channels extending across said defined area;

(b) said first channels substantially co-planar with one another;

(c) a plurality of second channels interconnecting end portions of respective pairs of said first channels to form a single confined region such that said first channels confine an ionizable medium for producing light under influence of an electric discharge; and (d) said second channels substantially co-planar with one another while not being co-planar with said first channels, and (e) said lamp further comprising:

(i) said first channels formed by a first plate;

(ii) said second channels formed by a third plate; and (iii) a substantially flat second plate sandwiched between said first plate and said third plate.

2. The lamp of claim 1 wherein said second plate includes an opening therein to interconnect at least one of said first channels and at least one of said second channels.

3. The lamp of claim 2 wherein said opening is circular.

4. The lamp of claim 2 wherein said opening is aspherical.

5. The lamp of claim 2 wherein said opening is positioned proximate the end of said at least one of said first channels such that light is illuminated substantially uniformly to said end of said at least one of said first channels.

6. The lamp of claim 1 wherein said first plate is hermetically sealed to said second plate, and said third plate is hermetically sealed to said second plate.

7. The lamp of claim 1 wherein said second plate includes a plurality of openings therein to interconnect said first channels and said second channels in a manner to form a continuous gas discharge path between a pair of electrodes.

8. The lamp of claim 1 further comprising:

(a) at least one of said first channels is coated with phosphor;

(b) said second plate includes an opening therein to interconnect said at least one of said first channels and at least one of said second channels; and (c) said at least one of said second channels is coated with phosphor in a region under said opening so that light is provided through said opening from said at least one second channel.

9. The lamp of claim 8 wherein said at least one second channel is free from phosphor other than in said region.

10. A flat form gas discharge lamp for illuminating a defined area comprising:

(a) a support plate;

(b) a first plurality of adjacent parallel, co-planar hollow channels formed in a top plated affixed to a top side of said support plate;

(c) a second plurality of hollow interconnecting channels interconnecting end portions of respective pairs of said first plurality of channels, said second plurality of channels being formed in at least one bottom plate affixed to a bottom side of said support plate and communicating with said first plurality of channels through apertures in said support plate so as to form with said first plurality of channels a single confined region containing an ionizable medium for producing light under the influence of an electric discharge.

11. The flat form gas discharge lamp of claim 10 wherein said apertures have a circular shape.

12. The flat form gas discharge lamp of claim 11 wherein said apertures have an aspherical shape.

13. The flat form gas discharge lamp of claim 10 wherein said first plurality of channels are coated with phosphor.

14. The flat form discharge lamp of claim 13 wherein said phosphor is at least one of magnesium tungstate and calcium flourochlorophosphate: antimony: manganese.

* * * * *